United States Patent [19]

Bentley et al.

[11] 4,356,868

[45] Nov. 2, 1982

[54] FIRE-EXTINGUISHANT SYSTEM

[75] Inventors: Stanley L. Bentley, Indianapolis, Ind.; Frank A. Bloomer, Madison Heights, Mich.

[73] Assignee: Ransburg Corporation, Indianapolis, Ind.

[21] Appl. No.: 173,789

[22] Filed: Jul. 30, 1980

[51] Int. Cl.[3] ..... A62C 35/02

[52] U.S. Cl. ..... 169/26; 169/54; 169/5; 118/629

[58] Field of Search ..... 169/19, 20, 22, 5, 8, 169/54, 59, 42, 23, 26, 62; 239/706, 708; 118/629; 361/226, 227, 228; 251/12

[56] References Cited

U.S. PATENT DOCUMENTS

| | | | |
|---|---|---|---|
| 1,616,974 | 2/1927 | Josephson | 169/62 |
| 2,265,810 | 12/1941 | Lowe et al. | 169/20 |
| 2,561,229 | 7/1951 | Rider | 169/19 |
| 2,585,039 | 2/1952 | Rooke | 169/26 |
| 2,601,900 | 7/1952 | Rand et al. | 169/19 |
| 3,595,318 | 7/1971 | Merdinyan | 169/20 |
| 3,616,860 | 11/1971 | Willms | 169/19 |
| 3,827,502 | 8/1974 | Lockwood | 169/62 |
| 3,865,192 | 2/1975 | Dunphy | 169/62 |
| 4,248,309 | 2/1981 | Hofle et al. | 169/62 |

OTHER PUBLICATIONS

"Ansul A-101 Vehicle Fire Suppression Systems"; The Ansul Co.; Marinette, Wi.; 54143, 1980.

"Ansul Detection and Control Equipment Data Sheet SCAD$_{TM}$ Self-Contained Actuation and Detection System)"; The Ansul Co., Marinette, WI 54143; 1981.

*Primary Examiner*—Joseph J. Rolla
*Assistant Examiner*—Kenneth Noland
*Attorney, Agent, or Firm*—Jenkins, Coffey, Hyland, Badger & Conard

[57] ABSTRACT

A fire-extinguishant system includes a source of extinguishant, such as carbon dioxide, a fusible length of plastic tubing, such as one-half-inch-outside-diameter polyethylene tubing, with the end closed, and a conduit and valve system for connecting the extinguishant source to the fusible tubing. The valving system pressurizes the fusible tubing at a low pressure, and this low-pressure signal is coupled to a pilot input port in the valve system. When this low-pressure pilot signal is interrupted, the piloted valve switches to supply extinguishant at full pressure through the fusible tubing. If the fusible tubing has been melted, such as by a fire, the extinguishant exits through the melted portion to extinguish the fire. The low-pressure pilot signal can, however, be interrupted manually by the valve system. In this case, the full-pressure extinguishant supply to the fusible tube ruptures the tube and releases extinguishant. This provides a manual extinguishant control for the system.

14 Claims, 2 Drawing Figures

FIRE-EXTINGUISHANT SYSTEM

This invention relates to fire-extinguishant systems, and particularly to an extinguishant system which is useful in a material-coating system utilizing electrostatic spray-coating equipment of the type illustrated in U.S. Pat. No. 3,155,539; U.S. patent application Ser. No. 13,125, assigned to the same assignee as the present invention; and, U.S. Pat. No. 4,159,806.

In coating material dispensing sytems where quantities of solvent and coating material are atomized by a dispensing device and transferred to a target, there is always a considerable hazard of fire. The mixture of air, solvent, and coating material particles which always exists in such environments practically cannot be avoided and typically is quite flammable. Many types of detection systems are available, but they typically require extensive and complex installation, explosion-proof wiring, conduits, sophisticated heat sensors, and in certain units, ultraviolet light detectors. These types of systems are quite expensive, and further do not give the protection in certain confined areas such as the insides of atomizing device fairings, shrouds, and color-change manifold cabinets and equipment cabinets, which are as vulnerable to ignition as the space between the atomizing device and target. Additionally, in systems in which the atomizing devices are mounted on fluid motor rams and the like for reciprocation or other motion during a coating cycle, it is practically impossible to provide flexible explosion-proof conduit capable of following the reciprocations or other motions of the atomizing device positioner. A further fact of coating material application technology which compounds the problem of fire detection and extinguishment is that high efficiency coating is done with an electrostatic potential established between the coating material dispensing device and the target. This potential establishes an electric field and charges the particles of coating material which migrate through the field under its influence to the target to coat it at high efficiencies. Therefore, in addition to having solvent vapors, charged coating material particles and air in the space surrounding the dispensing device, a typical system has the dispensing device placed at a high-magnitude electrostatic potential, and a nearby target as well as surounding equipment, at essentially ground potential. To insure that the high-magnitude potential is maintained on the atomizing device, therefore, any kind of sensor which contacts, or lies closely adjacent the dispensing device must preserve the insulation between the device and ground.

The system of the present invention is designed to provide an extremely low-cost fire detection and extinguishment system for use in such an environment. The system sensor maintains the integrity of the high-magnitude potential on the dispensing device. That is, the sensor does not establish a ground or low-resistance path to ground from the dispensing device.

According to the invention, a fire-extinguishant system includes a source of extinguishant, a fusible means for stopping the flow of extinguishant from the source and for permitting such flow when melted by the heat of a fire, means for mounting the fusible means adjacent an area to be bathed by extinguishant in case of fire in that area, and means for coupling the fusible means to the source of fire extinguishant. The fusible means includes a low-pressure-containing conduit, and the means for coupling the fusible means to the extinguishant source comprises a pressure-release-actuated valve for switching to provide an extinguishant flow path to the fusible means from the extinguishant source when the fusible means melts to interrupt the low pressure in the low-pressure-containing conduit.

Further, according to the present invention, a material-coating system includes a device for dispensing coating material, a source of high-magnitude electrostatic potential, means for coupling a portion of the device to the high-potential source, means for insulating the device portion from ground potential to prevent discharge of the portion, a target to be coated by dispensed coating material from the device, means for maintaining the target at a low-magnitude potential relative to the source potential, with the coating material migrating in the field established between the device and target to coat the target at high efficiency, and a fire-extinguishant system. The fire-extinguishing system includes a source of fire extinguishant, a fusible means for stopping the flow of fire extinguishant and for permitting such flow when melted by the heat of a fire, means for mounting the fusible means adjacent the said device portion, and means for coupling said fusible means to said source of fire extinguishant, with at least one of the fusible means and coupling means including means for electrically insulating the device portion to maintain a high-magnitude electrostatic potential on the device portion.

Additionally, according to the invention, the fusible means includes a low-pressure-containing conduit, and the means for coupling the fusible means to the extinguishant source includes a pressure-release-actuated valve for switching to provide an extinguishant flow path from the extinguishant source to the fusible means when the fusible means melts to interrupt the low pressure in the low-pressure-containing conduit. Additional means are provided for establishing the low pressure in the low-pressure-containing conduit. Illustratively, the low-pressure-providing means includes a low-pressure regulator having an input and an output, means for coupling the input of the low-pressure regulator to the extinguishant source, a selectively controlled, multiple-position valve having an input, means coupling the multiple-position valve input to the output of the regulator, and the multiple-position valve having a first output, with a first position of the multiple-position valve coupling the first output to the fusible means to provide low-pressure pressurization of the low-pressure-containing conduit. The multiple-position valve also has a second position uncoupling the regulator output from the fusible means and venting the fusible means to trigger the pressure-release-actuated valve to switch to provide an extinguishant flow path directly from the extinguishant source to the fusible means. The pressure of extinguishant from the source through the pressure-release-actuated valve ruptures the fusible means to provide a flow of extinguishant. This provides the system with a manual extinguishant control.

Further, according to the invention, the apparatus includes an alarm valve responsive to interruption of the low-pressure signal to control an alarm. The system illustratively further includes a second source of fire extinguishant, such as a water supply, and a timer for controlling flow of the extinguishant from the second source. The alarm valve controls initiation of a timing interval by the timer, and the timer triggers the extinguishant flow from the second source at the end of the timing interval.

The invention may best be understood by referring to the following description and accompanying drawings which illustrate the invention. In the drawings.

Figure 1:
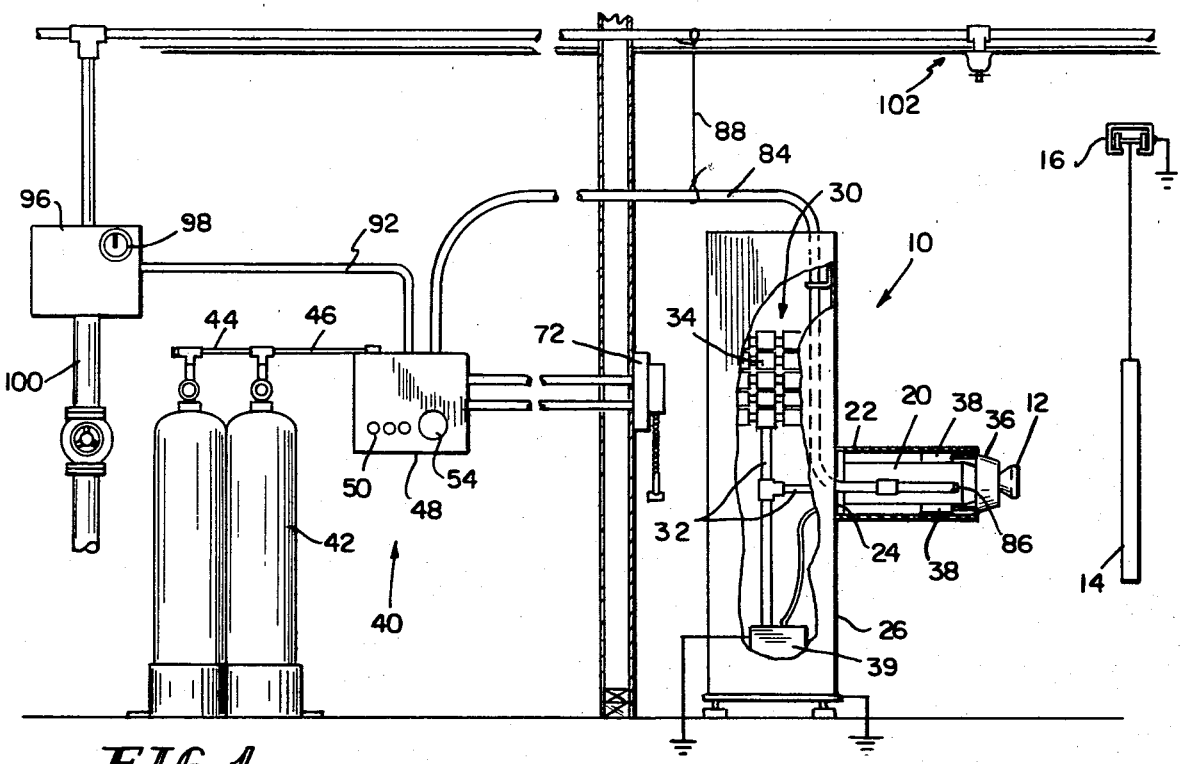
FIG. 1 is an elevational view of a typical installation.
Figure 2:
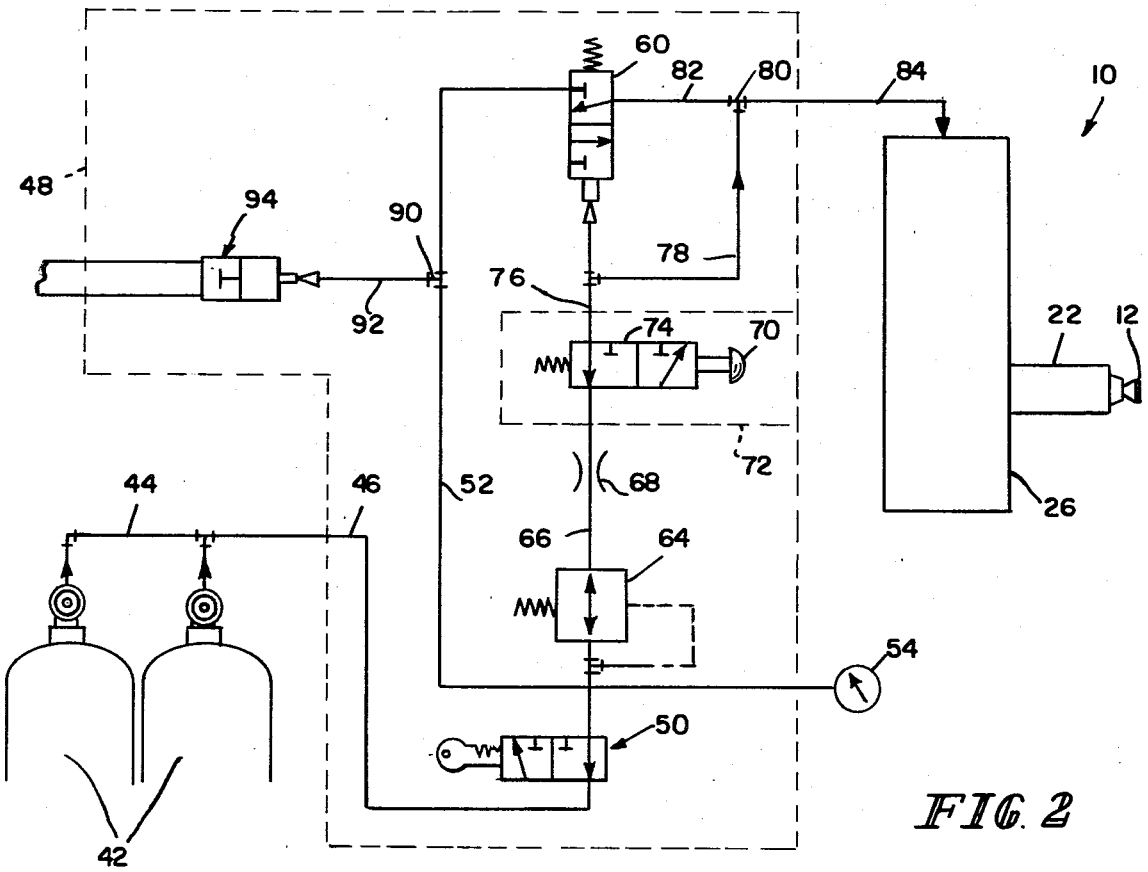
FIG. 2 is a partly elevational and partly schematic diagram of the extinguishant circuit of FIG. 1.

Referring to FIGS. 1–2, a coating dispensing installation 10 includes a device 12 for atomizing and dispensing coating material onto targets 14 as the targets are conveyed serially past the device 12 on a conveyor 16. Device 12 can be of any of a number of known types such as, for example, the device of U.S. Pat. No. 4,148,932. The device 12 is mounted on an insulated column 20 inside of a fairing 22. Both the column 20 and fairing 22 are attached at their ends remote from device 12 to a bulkhead 24 provided on the side of a cabinet 26 containing color-change equipment 30. Equipment 30 is controlled remotely by a program controller (not shown) of any of a number of known types. The controller sequences the color-change equipment 30 to provide a supply of coating material from one of a number of different coating material sources (also not shown) through a coating material supply line 32 which runs from the color-change equipment manifold 34 to the bulkhead 24. A passageway extending the length of column 20 conveys a selected color from the supply line 32 to the device 12 for atomization and projection toward the targets 14 as they move serially past device 12.

Typically, it is necessary to change colors between, for example, adjacent targets 14 as they move along on the conveyor 16. Therefore, a color-change cycle can be programmed into the control device and executed by the equipment in installation 10 such that, between the coating of one target 14 and the coating of the next adjacent target 14 as they move along on the conveyor 16, a shroud 36 is projected by fluid motors 38 axially to surround device 12, the flow of coating material from the color-change equipment 30 is turned off, the flow of a solvent is turned on, the solvent flushes the manifold 34 and coating material supply lines 32 and the device 12, a supply of a drying gas, such as air, is opened into manifold 34, supply line 32 and device 12 to dry the solvent, and finally a different color valve in equipment 30 opens and a new color is supplied to the device 12. The cycle, and various types of equipment for achieving it, are known in the art. Examples of the equipment and cycle are discussed in U.S. Pat. No. 3,155,539 and U.S. Pat. No. 4,159,806.

As illustrated in U.S. patent application Ser. No. 13,125, assigned to the same assignee as the present invention, the coating material supplies, the service for the motor mounted in column 20 which drives device 12, the services for motors 38 which drive shroud 36, and all other necessary services to drive device 12 and perform all of the essential operations, are provided through the interior of the insulated column 20.

No electrically conductive conduits or the like can extend through column 20, since in a typical installation, high electrostatic potential is supplied from a source 39 within cabinet 26 through column 20 to charge device 12 to a high electrostatic potential. A high potential supply for this purpose is described in detail in U.S. Pat. No. 4,075,677. Conveyor 16 and targets 14 are typically maintained at substantial ground potential. The coating material particles which are dispensed by device 12 are charged by virtue of their contact with device 12 and migrate under the influence of the field established between device 12 and target 14 to coat the target 14 at high coating efficiencies. The system 40 for extinguishing fires within cabinet 26 and fairing 22 includes a source 42 of extinguishant. Source 42 illustratively includes two tanks of carbon dioxide joined by a manifold 44. A conduit 46 extends from the manifold 44 to a cabinet 48 which houses the control valves for system 40. These control valves include a key-operated security and maintenance switch 50 in series between conduit 46 and a supply conduit 52. A pressure gauge 54 in conduit 52 provides a continuous reading of the pressure in conduit 52. When the key-operated valve 50 is in its open position, the pressure of extinguishant provided by source 42 can be read directly from gauge 54. When there is no reading on gauge 54, either the extinguishant in source 42 is exhausted or valve 50 is in its closed position.

A normally closed piloted three-way valve 60 terminates conduit 52. Extinguishant at source 42 pressure is also available to the input port of a regulator 64. Regulator 64 is adjustable such that a relatively low extinguishant pressure is available at its output port, from which the low pressure extinguishant is supplied through a conduit 66 containing a flow restrictor 68 to a valve 74 controlled by a manual emergency break-glass palm button 70 mounted in a case 72 (FIG. 1) in the coating area. Button 70 operates valve 74 in a manner to be described. Under ordinary operating conditions, valve 74 supplies low pressure extinguishant from conduit 66 through a conduit 76 to the piloting input port of valve 60. This low pressure is also supplied through a conduit 78 to a fitting 80. A conduit 82 extends from fitting 80 to valve 60. A piece of flexible, electrically insulative, fusible tubing or hose 84, illustratively a one-half inch (12.7 mm.) outside diameter polyethylene hose, extends from fitting 80 into the coating area, into the cabinet 26, through the bulkhead 24 and inside of fairing 22 all of the way to the end of the fairing adjacent device 12. As previously mentioned, although this tubing 84 is illustrated as a straight run of cable from cabinet 48 (in which fitting 80 is housed) into cabinet 26 and to the end of fairing 22, the hose 84 can be looped, etc., if the device 12 is mounted for reciprocating or other movement so that there is sufficient slack between fitting 80 and the remote end 86 of the fusible member 84 to permit such movement. As illustrated in FIG. 1, a piece of rubber chord 88 or other insulative material can be used to suspend the run of fusible member 84 between cabinet 48 and cabinet 26 from an overhead support. The remote end 86 of fusible member 84 is closed, e.g., by a fusible plug to prevent the escape of low pressure extinguishant from source 42.

A high pressure extinguishant pilot tap 90 extends from conduit 52 through a conduit 92 to a normally closed piloted valve 94 which operates a plant fire alarm 96 and starts a timer 98 (FIG. 1). Timer 98 controls a valve which controls the supply of water from a plant water supply pipe 100 to an overhead water deluge sprinkler 102 in the coating area.

In operation, the key-operated valve 50 is operated to open the supply from the extinguishant source 42 to gauge 54. Low pressure extinguishant is supplied through regulator 64, restrictor 68, valve 74, and conduit 78 to pressurize fusible member 84. This low pressure extinguishant also is supplied through conduit 76 to the piloting input port of valve 60 to keep high pressure extinguishant in conduit 52 from entering fusible member 84 through conduit 82. Assuming that a fire starts in the vicinity of fusible member 84 anywhere along its length, a hole is melted in the fusible member 84, releasing the low pressure extinguishant from the fusible member 84, and conduits 78, 76. Release of the pilot pressure from valve 60 connects conduit 52 directly through conduit 82 to the fusible member 84. High pressure extinguishant is supplied directly to the point in the fusible member where the melt has occurred, and is applied directly to the fire. The pressure drop occurring in conduit 52 when piloted valve 60 switches is sensed through conduit 92 at the pilot input port of valve 94. Valve 94 switches to energize the plant fire alarm 96 (FIG. 1). This switching also starts timer 98 which, at the end of a timing interval, opens the valve between the plant water supply 100 and the sprinkler system 102 to deluge the coating area with water.

Assuming now that a fire has started which is in the vicinity of the fusible member 84, but has not melted a hole in it for whatever reason, the palm button 70 can be actuated by the workman detecting the fire. Actuation of the palm button vents the pressure in fusible member 84 and conduits 82, 78, 76 to atmosphere, piloting valve 60 in the same manner as if a hole had been melted in fusible member 84. Full pressure extinguishant from source 42 is coupled through conduit 52, valve 60 and conduit 82 to the fusible member 84. The presence of high pressure in member 84 ruptures member 84, blanketing the interior of cabinet 26 and fairing 22 in extinguishant. The secondary extinguishant system involving tap 90, conduit 92, valve 94, timer 98, water supply 100, and sprinkler system 102 is actuated, just as in the preceding discussion. The alarm 96 is also sounded.

What is claimed is:

1. In a material coating system including a device for dispensing coating material, a source of high magnitude electrostatic potential, means for coupling a portion of the device to the high potential source, means for insulating said device portion from ground potential to prevent discharge of said portion, a target to be coated by dispensed coating material from the device, and means for maintaining the target at a low magnitude potential relative to the source potential; a fire extinguishing system comprising a source of fire extinguishant, a fusible means for stopping the flow of fire extinguishant and for permitting such flow when melted by the heat of a fire, means for mounting the fusible means adjacent said device portion, and means for coupling said fusible means to said source of fire extinguishant, at least one of said fusible means, said coupling means and said source of extinguishant including means for electrically insulating said device portion to maintain the high magnitude potential on said device portion.

2. The apparatus of claim 1 wherein the fusible means comprises a low pressure-containing conduit, and the means for coupling the fusible means to the extinguishant source comprises a pressure release actuated valve for switching to provide an extinguishant flow path from the extinguishant source to the fusible means when the fusible means melts to interrupt the low pressure in the low pressure-containing conduit.

3. The apparatus of claim 2 and further comprising means for providing the low pressure in the low pressure-containing conduit.

4. The apparatus of claim 3 wherein the low pressure-providing means comprises a low pressure regulator having an input and an output, means for coupling the input of the low pressure regulator to the extinguishant source, a selectively controllable multiple position valve having an input, means coupling said multiple position valve input to the output of said regulator, a first output, a first position of said multiple position valve coupling said first output to said fusible means to provide low-pressure pressurization thereto, said multiple position valve having a second position uncoupling said regulator output from said fusible means and venting said fusible means to trigger said pressure release actuated valve to switch to provide an extinguishant flow path from said extinguishant source to said fusible means, pressure of extinguishant from said source through said pressure release actuated valve rupturing said fusible means to provide a selectively controllable flow of extinguishant.

5. The apparatus of claim 2 and further comprising an alarm valve responsive to interruption of the low pressure signal to energize an alarm.

6. The apparatus of claim 5 and further comprising a second source of fire extinguishant and a timer for controlling flow of extinguishant from said second source, said alarm valve controlling initiation of a timing interval by said timer, said timer triggering extinguishant flow from said second source at the end of said timing interval.

7. A fire extinguishant system comprising a source of fire extinguishant, a fusible means for stopping the flow of extinguishant from the source and for permitting such flow when melted by the heat of a fire, and means for coupling the fusible means to the source of fire extinguishant, the fusible means including a conduit across the wall of which a pressure differential is established, and the means for coupling the fusible means to the extinguishant source comprising a pressure change actuated valve for switching to provide an extinguishant flow path from the extinguishant source to the fusible means when the fusible means melts to change the pressure in the conduit, and means for providing the pressure differential across the wall of the conduit, the pressure differential providing means comprising a pressure regulator having an input and an output, means for coupling the pressure regulator input to the extinguishant source, a selectively controllable multiple position valve having an input, means coupling said multiple position valve input to the output of said pressure regulator, a first output, a first position of said multiple position valve coupling said first output to said fusible means to pressurize said conduit, said multiple position valve having a second position uncoupling said regulator output from said fusible means and venting said conduit to disrupt the pressure differential across the wall thereof and trigger said pressure change actuated valve to switch to provide an extinguishant flow path from said extinguishant source to said fusible means, pressure of extinguishant from said source through said pressure change actuated valve rupturing the wall of said conduit to provide a flow of extinguishant.

8. A fire-extinguishing system comprising:

a source of fire extinguishant maintained at an elevated pressure, first and second conduits, and means coupling the first and second conduits to the source of fire extinguishant, regulator means for reducing the pressure of the extinguishant, the regulator means in the first conduit, a fusible conduit for containing extinguishant at a reduced pressure in the vicinity of a possible source of fire, and means for coupling the fusible conduit to the regulator means, and a pressure change-actuated valve and means for coupling the pressure change-actuated valve to the fusible conduit and to the source of fire extinguishant through the second conduit, the pressure change-actuated valve being responsive to a drop in pressure in the fusible conduit for switching to provide a flow path of extinguishant at the elevated pressure of the source through the fusible conduit.

9. The fire-extinguishing system of claim 8 further comprising a manually operable valve and means for coupling the manually operated valve to the fusible conduit for venting said conduit and thereby triggering said pressure change-actuated valve, the pressure of the extinguishant admitted through the pressure change-actuated valve to the fusible conduit and the strength of the fusible conduit being such as will cause the fusible conduit to rupture to provide a flow of extinguishant.

10. A fire-extinguishing system comprising a source of fire extinguishant maintained at an elevated pressure, first and second conduits, and means coupling the first and second conduits to the source of fire extinguishant, regulator means for reducing the pressure of the extinguishant, the regulator means in the first conduit, a fusible conduit for containing extinguishant at a reduced pressure in the vicinity of a possible source of fire, and means for coupling the fusible conduit to the regulator means, a pressure change-actuated valve and means for coupling the pressure change-actuated valve to the fusible conduit and to the source of fire extinguishant through the second conduit, the pressure change-actuated valve being responsive to a drop in pressure in the fusible conduit for switching to provide a flow path of extinguishant at the elevated pressure of the source through the fusible conduit, a manually operable valve, means for coupling the manually operated valve to the fusible conduit for venting said conduit and thereby triggering said pressure change-actuated valve, the pressure of the extinguishant admitted through the pressure change-actuated valve to the fusible conduit and the strength of the fusible conduit being such as will cause the fusible conduit to rupture to provide a flow of extinguishant, a second pressure change-actuated valve, means for coupling the second pressure change-actuated valve to the second conduit, a second source of extinguishant, means for coupling the second extinguishant source to the second pressure change-actuated valve, an additional extinguishant distribution means, and means for coupling the additional extinguishant distribution means to the second source of extinguishant through the second pressure change-actuated valve such that a change in pressure of the extinguishant in the second conduit triggers the distribution of extinguishant from the second source through the additional extinguishant distribution means.

11. The fire-extinguishing system of claim 10 further comprising a time delay means and means for coupling the time delay means to the second pressure change actuated valve for delaying the distribution of extinguishant from the second source for a preselected period of time after the sensing of the change in pressure in the second conduit.

12. In a material-coating system including a device for dispensing coating material and a target to be coated by material dispensed from the device, and means for maintaining an electrostatic potential difference across the device-target spacing, a fire extinguishant system comprising a source of fire extinguishant, a fusible means for stopping the flow of extinguishant from the source and for permitting such flow when melted by the heat of a fire, means for mounting the fusible means adjacent the material-coating system, and means for coupling the fusible means to the source of fire extinguishant, the fusible means including a conduit across the wall of which a pressure differential is established, and the means for coupling the fusible means to the extinguishant source comprising a pressure change actuated valve for switching to provide an extinguishant flow path from the extinguishant source to the fusible means when the fusible means melts to change the pressure in the conduit.

13. The apparatus of claim 12 and further comprising means for providing the pressure differential across the wall of the conduit.

14. The apparatus of claim 13 wherein the pressure differential providing means comprises a pressure regulator having an input and an output, means for coupling the pressure regulator input to the extinguishant source, a selectively controllable multiple position valve having an input, means coupling said multiple position valve input to the output of said pressure regulator, a first output, a first position of said multiple position valve coupling said first output to said fusible means to pressurize said conduit, said multiple position valve having a second position uncoupling said regulator output from said fusible means and venting said conduit to disrupt the pressure differential across the wall thereof and trigger said pressure change actuated valve to switch to provide an extinguishant flow path from said extinguishant source to said fusible means, pressure of extinguishant from said source through said pressure change actuated valve rupturing the wall of said conduit to provide a flow of extinguishant.

* * * * *